US006669322B2

(12) United States Patent
Gaston et al.

(10) Patent No.: US 6,669,322 B2
(45) Date of Patent: Dec. 30, 2003

(54) METHOD AND SYSTEM FOR CALIBRATING INK EJECTION ELEMENTS IN AN IMAGE FORMING DEVICE

(75) Inventors: David Gaston, Barcelona (ES); Francesc Subirada, Castellbisbal (ES); Xavier Soler, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/984,937

(22) Filed: Oct. 31, 2001

(65) Prior Publication Data

US 2003/0081037 A1 May 1, 2003

(51) Int. Cl.[7] ..... B41J 29/393
(52) U.S. Cl. ..... 347/19
(58) Field of Search ..... 347/19, 14, 23, 347/41, 44, 37, 16, 15, 9, 12, 10, 11, 5; 356/372; 400/55, 56, 58, 59

(56) References Cited

U.S. PATENT DOCUMENTS 5,576,744 A 11/1996 Niikura et al. ..... 347/14
5,767,988 A 6/1998 Dobbs et al. ..... 358/474
5,798,773 A * 8/1998 Hiramatsu et al. ..... 347/19
5,905,512 A 5/1999 Beauchamp ..... 347/19
6,037,584 A 3/2000 Johnson et al. ..... 250/235

* cited by examiner

*Primary Examiner*—Raquel Yvette Gordon
*Assistant Examiner*—Charles W. Stewart, Jr.

(57) ABSTRACT

By implementation of an optical scanner, the calibration of printheads of a printing mechanism may be performed in a relatively short period of time as compared to known techniques. In one respect, the time required to perform the calibration may be substantially reduced by virtue of the relatively wide field of view of the optical scanner. The relatively wide field of view generally enables for the scanning of test patterns to be performed with a relatively fewer number of scanning passes, thus reducing the time required to perform the scanning operations as well as the calibration operations. In addition, the scanning operations may yield relatively more accurate results as compared to known scanning operations. In one respect, optical scanners are capable of detecting smaller drops of ink on print media by virtue of their higher resolution capabilities. In another respect, all of the printed colors may be accurately detected through implementation of a red, green, blue (RGB) charge coupled device (CCD) contained in the optical scanners.

15 Claims, 4 Drawing Sheets

METHOD AND SYSTEM FOR CALIBRATING INK EJECTION ELEMENTS IN AN IMAGE FORMING DEVICE

FIELD OF THE INVENTION

This invention relates generally to printing devices. More particularly, the invention pertains to optics systems and methods for performing ink ejection element detection and calibration operations.

BACKGROUND OF THE INVENTION

Inkjet printing mechanisms, e.g., printers, plotters, photocopiers, facsimile machines, etc., typically implement inkjet cartridges, often called "pens" to shoot drops of ink onto a sheet of print media, e.g., paper, fabric, textile, and the like. Some inkjet printing mechanisms carry an ink cartridge with an entire supply of the ink back-and-forth across the sheet. Other inkjet print mechanisms, known as "off-axis" systems, propel only a small ink supply with the printhead carriage across the print zone, and store the main ink supply in a stationary reservoir, which is located off-axis from the path of the printhead travel. Typically, a flexible conduit or tubing is used to convey the ink from the off-axis reservoir to the printhead cartridge.

Inkjet printing mechanisms typically comprise a plurality of inkjet pens of various colors. For example, a typical inkjet printer/plotter may comprise four pens, one that prints black ink, and three that print colored inks, e.g., magenta, cyan and yellow. The colors from the three color pens are typically mixed to obtain any particular color.

The pens are typically mounted in stalls within an assembly that is mounted on the carriage assembly of the printing mechanism. The carriage assembly generally positions the inkjet pens and typically holds the circuitry required for interface with components, e.g., firing resistors, piezoelectric elements, and the like, that operate the inkjet pens.

Color printing and plotting generally requires that inks from each pen be precisely applied to the print media. This requires precise alignment of the carriage assembly. However, mechanical misalignment of the pens in conventional inkjet printing mechanisms typically results in offsets in the direction of carriage travel and offsets in the direction of print media travel. This misalignment of the print carriage assembly manifests as a misregistration of the images applied by the pens. In addition, other misalignments may arise due to the speed of the carriage, the curvature of the platen and/or spray from the nozzles, and the like. Furthermore, the misalignments may arise from difficulties that may arise during the manufacture of the pens, such as imperfect nozzle shape and/or placement.

One manner in which conventional printing mechanisms attempt to overcome the problems associated with the carriage assembly misalignments is through implementation of optical systems designed to perform detections on a test strip. More specifically, conventional printing mechanisms may include optical detectors mounted on the carriage assembly for detecting test strips printed by each of the pens. The optical detectors typically consist of one or more light emitting diodes (LED), typically of different colors, that illuminate an area or surface of the media and an optical sensor that receives the signal reflected from the media. Although conventional optical systems have been found to be effective in detecting relative small test strips and certain colors, they also have certain drawbacks and disadvantages.

For example, conventional optical systems have a substantially limited field of view (e.g., about 1270×1270 $\mu$m).

Therefore, detection of relatively wide areas with conventional optical systems require performance of several scans, thereby increasing the time required to perform the detections. In addition, conventional optical systems are often limited to sensing colors in the bands of the color spectrum corresponding to the LEDs implemented in the optical systems. One consequence of which is that some of the printed colors may not be accurately detected by the optical systems. Thus, although conventional optical systems have been relatively effective in detecting test strips formed by pens having relatively small swath heights (i.e., pens having a relatively small number of nozzles), conventional optical systems are ill-equipped to detect test strips formed by today's printing mechanisms that utilize pens having a much larger number of nozzles.

SUMMARY OF THE INVENTION

According to an embodiment, the present invention pertains to a method of calibrating ink ejection elements of an image forming device, the image forming device comprising a carriage supporting the ink ejection elements and an optical scanner. In the method, a test pattern is printed onto a print medium with the ink ejection elements. The test pattern is sensed with the optical scanner. In addition, it is determined whether any of the ink ejection elements contains at least one defect, and the ink ejection elements that are determined to contain at least one defect are calibrated.

In accordance with an aspect, the present invention relates to a system for calibrating ink ejection elements in an image forming device. The system includes a controller operable to control the ink ejection elements to fire a set of ink drops onto a print medium in the form of a test pattern and an optical scanner configured to sense the test pattern. The controller is configured to determine whether any of the ink ejection elements contains at least one defect by analyzing the test pattern. In addition, the controller is further configured to calibrate ink ejection elements that are determined as containing at least one defect.

According to yet another aspect, the present invention relates to a computer readable storage medium on which is embedded one or more computer programs. The one or more computer programs implement a method for calibrating ink ejection elements of an image forming device. The one or more computer programs include a set of instructions for printing a test pattern onto a print medium with said ink ejection elements. The one or more computer programs include a set of instructions for sensing said test pattern with an optical scanner. The one or more computer programs also include a set of instructions for determining whether any of the ink ejection elements contains at least one defect. The one or more computer programs further includes a set of instructions for calibrating the ink ejection elements determined to contain at least one defect.

In comparison to known data center cooling mechanisms and techniques, certain embodiments of the invention are capable of achieving certain aspects, including some or all of the following: (1) scanning a relatively wide test pattern area during a single scanning pass to thereby reduce the time required to perform test pattern sensing operations; (2) ability to scan smaller ink drops; (3) ability to scan a greater gamut of colors; and (4) ability to scan images from print medium. Those skilled in the art will appreciate these and other benefits of various embodiments of the invention upon reading the following detailed description of a preferred embodiments.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structure have not been described in detail so as not to unnecessarily obscure the present invention.

According to an embodiment of the present invention, the calibration of the printheads of a printing mechanism may be performed in a relatively short period of time as compared to known techniques. In one respect, the time required to perform the calibration may be substantially reduced by implementation of an optical scanner configured to have a relatively wide field of view. The relatively wide field of view generally enables for the scanning of test patterns to be performed with a relatively fewer number of scanning passes, thus reducing the time required to perform the scanning operations as well as the calibration operations.

In addition, the scanning operations according to the present invention may yield relatively more accurate results as compared to known scanning operations. In one respect, optical scanners are capable of detecting smaller drops of ink on print media by virtue of their higher resolution capabilities. In another respect, all of the printed colors may be accurately detected through implementation of a red, green, blue (RGB) charge coupled device (CCD) contained in the optical scanners.

As used throughout the present disclosure, the terms "optical scanner" generally refer to a scanner module often implemented in conventional image capturing devices. That is, an image capturing device containing a CCD for capturing images from a print media for use in, for example, a computing device.

Figure 1:
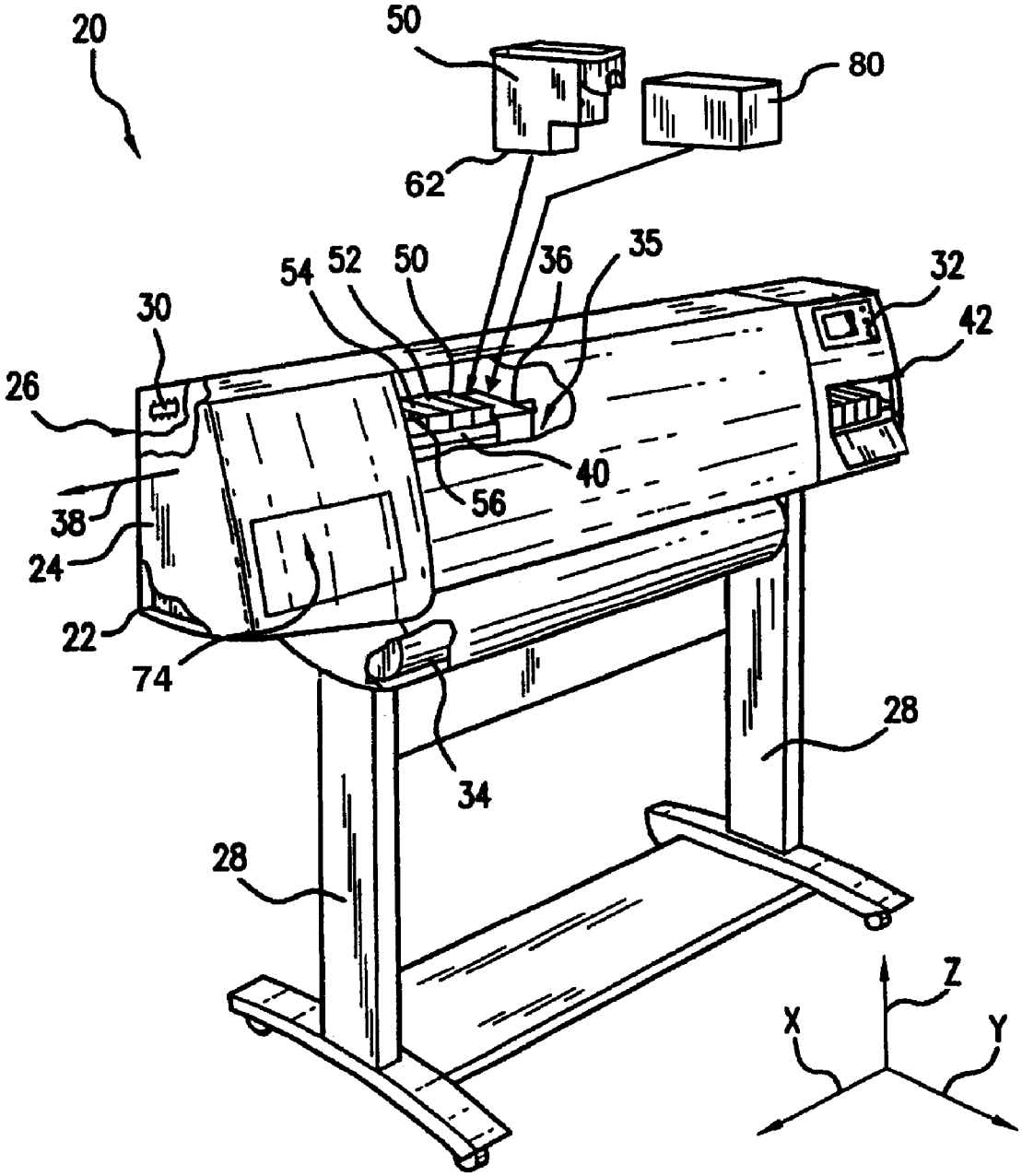
FIG. 1 illustrates an embodiment of a printer constructed in accordance with the principles of the present invention.

FIG. 1 illustrates an embodiment of a printer 20 constructed in accordance with the principles of the present invention, which may be used for recording information onto a recording medium, such as, paper, textiles, and the like, in an industrial, office, home or other environment. The present invention may be practiced in a variety of printers. For instance, it is contemplated that an embodiment of the present invention may be practiced in large scale textile printers, desk top printers, portable printing units, copiers, cameras, video printers, and facsimile machines, to name a few. For convenience, the concepts of the present invention are illustrated in the environment of the printer 20.

While it is apparent that the printer components may vary from model to model, the printer 20 includes a chassis 22 surrounded by a housing or casing enclosure 24, typically of a plastic material, together forming a print assembly portion 26 of the printer 20. Additionally, the print assembly portion 26 may be supported by a desk or tabletop, however, it is preferred to support the print assembly portion 26 with a pair of leg assemblies 28. The printer 20 also has a printer controller 30, illustrated schematically as a microprocessor, that receives instructions from a host device (not shown), typically a computer, such as a personal computer or a computer aided drafting (CAD) computer system. The printer controller 30 may also operate in response to user inputs provided through a key pad and a status display portion 32, located on the exterior of the casing 24. A monitor coupled to the host device may also be used to display visual information to an operator, such as the printer status or a particular program being run on the host device. Personal and drafting computers, their input devices, such as a keyboard and/or a mouse device, and monitors are all well known to those skilled in the art.

A conventional recording media handling system (not shown) may be used to advance a continuous sheet of recording media 34 from a roll through a print zone 35. Moreover, the illustrated printer 20 may also be used for printing images on pre-cut sheets, rather than on media supplied in a roll 34. The recording media may be any type of suitable sheet material, such as paper, poster board, fabric, transparencies, mylar, vinyl, and the like. A carriage guide rod 36 is mounted to the chassis 22 to define a scanning axis 38, with the guide rod 36 slideably supporting a carriage 40 for travel back and forth, reciprocally, across the print zone 35. A conventional carriage drive motor (not shown) may be used to propel the carriage 40 in response to a control signal received from the controller 30. To provide carriage positional feedback information to controller 30, a conventional metallic encoder strip (not shown) may be extended along the length of the print zone 35 and over a servicing region 42.

A conventional optical encoder reader may be mounted on the back surface of carriage 40 to read positional information provided by the encoder strip. The manner of providing positional feedback information via the encoder strip reader, may also be accomplished in a variety of ways known to those skilled in the art.

The printer 20 contains four cartridges 50–56. In the print zone 35, the recording medium receives ink from cartridges 50–56. The cartridges 50–56 are also often called "pens" by those in the art. One of the pens, for example pen 50, may be configured to eject black ink onto the recording medium, where the black ink may contain a pigment-based ink. Pens 52–56 may be configured to eject variously colored inks, e.g., yellow, magenta, cyan, light cyan, light magenta, blue, green red, to name a few. For the purposes of illustration, pens 52–56 are described as each containing a dye-based ink of the colors yellow, magenta and cyan, respectively, although it is apparent that the color pens 52–56 may also contain pigment-based inks in some implementations. It is apparent that other types of inks may also be used in the pens 50–56, such as paraffin-based inks, as well as hybrid or composite inks having both dye and pigment characteristics.

The printer 20 uses an "off-axis" ink delivery system, having main stationary reservoirs (not shown) for each ink (black, cyan, magenta, yellow) located in an ink supply region 74. In this respect, the term "off-axis" generally refers to a configuration where the ink supply is separated from the print heads 50–56. In this off-axis system, the pens 50–56 may be replenished by ink conveyed through a series of flexible tubes (not shown) from the main stationary reservoirs so only a small ink supply is propelled by carriage 40 across the print zone 35 which is located "off-axis" from the path of printhead travel. As used herein, the term "pen" or "cartridge" may also refer to replaceable printhead cartridges where each pen has a reservoir that carries the entire ink supply as the printhead reciprocates over the print zone.

The illustrated pens 50–56 have printheads (not shown) which selectively eject ink to form an image on a sheet of media 34 in the print zone 35. These printheads have a large print swath, for instance about 22.5 millimeters high or higher, although the printhead calibration concepts described herein may also be applied to smaller printheads. The printheads each have an orifice plate with a plurality of nozzles formed there through in a manner well known to those skilled in the art.

The nozzles of each printhead are typically formed in at least one, but typically two linear arrays along the orifice plate (not shown). Thus, the term "linear" as used herein may be interpreted as "nearly linear" or substantially linear, and may include nozzle arrangements slightly offset from one another, for example, in a zigzag arrangement. Each linear array is typically aligned in a longitudinal direction substantially perpendicular to the scanning axis 38, with the length of each array determining the maximum image swath for a single pass of the printhead.

The printer 20 also includes an optical scanner 80 configured to scan across test patterns printed by the pens 50–56.

Figure 2:
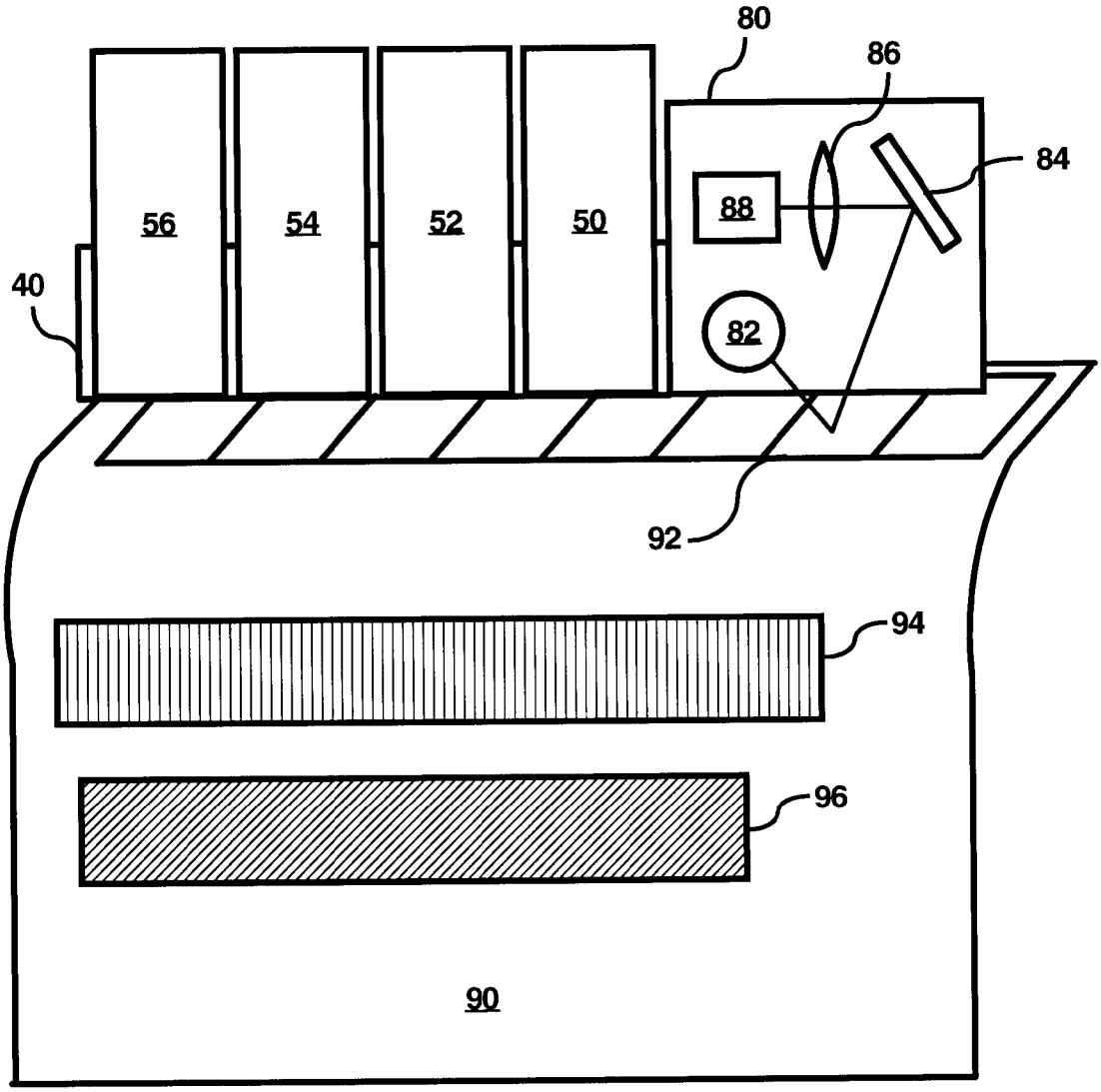
FIG. 2 is a close-up simplified cross-sectional view of the carriage portion of the printing mechanism of FIG. 1 showing a carriage-mounted optical scanner according to an embodiment of the present invention.

As best seen in FIG. 2, the printer 20 contains an optical scanner 80 connected to the carriage 40. The optical scanner 80 may be connected to the carriage 40 in any reasonably suitable manner that enables the optical scanner to scan over the print zone 35 in a manner that follows the movement of the pens 50–56 (i.e., the optical scanner is in line with the pens). Full-color printing and plotting require that the colors form the individual pens be precisely applied to the printing medium. This generally requires precise alignment of the carriage assembly. Unfortunately, paper slippage, paper skew, and mechanical misalignment of the pens in conventional inkjet printing mechanisms often result in offsets along both the medium or paper-advance axis and the scan or carriage axis.

A group of test patterns 92, 94, 96 is preferably generated (by activation of selected nozzles in selected pens while the carriage scans across the print medium 90) whenever any of pens is disturbed, e.g., just after a pen is replaced. The test patterns 92–96 are then read by scanning the optical scanner 80 over them and analyzing the results.

The optical scanner 80 senses the test patterns 92–96 and provides electrical signals to, for example, a processor (not shown) located on the carriage, indicative of the registration of the portions of the pattern produced by the different pens 50–56 respectively. In scanning the test patterns 92–96, the optical scanner 80 may include a field of view having a height substantially equal to the height of each of the test patterns 92–96. It is, however, envisioned that the field of view of the optical scanner 80 may be relatively greater or less than the swath height of the pens 50–56 without departing from the scope and spirit of the present invention.

In general, the optical scanner 80 may comprise any reasonably suitable, commercially available charge coupled device (CCD) scanner that is sized to fit on the carriage 40. The optical scanner 80 includes a light source 82, one or more reflective surfaces 84 (only one reflective surface is illustrated), a light focusing device 86, and a CCD 88. The optical scanner 80 captures images by illuminating the images with the light source 82 and sensing reflected light with the CCD 88. The CCD 88 may be configured to include various channels (e.g., red, green, and blue) to detect various colors using a single lamp or a one channel CCD (monochrome) with various color sources (e.g., light emitting diodes (LED)). A more detailed description of the manner in which the CCD 88 may operate to detect pixels of an image may be found in U.S. Pat. No. 6,037,584, assigned to the HEWLETT-PACKARD COMPANY. The disclosure contained in that patent is hereby incorporated by reference in its entirety.

Figure 3:
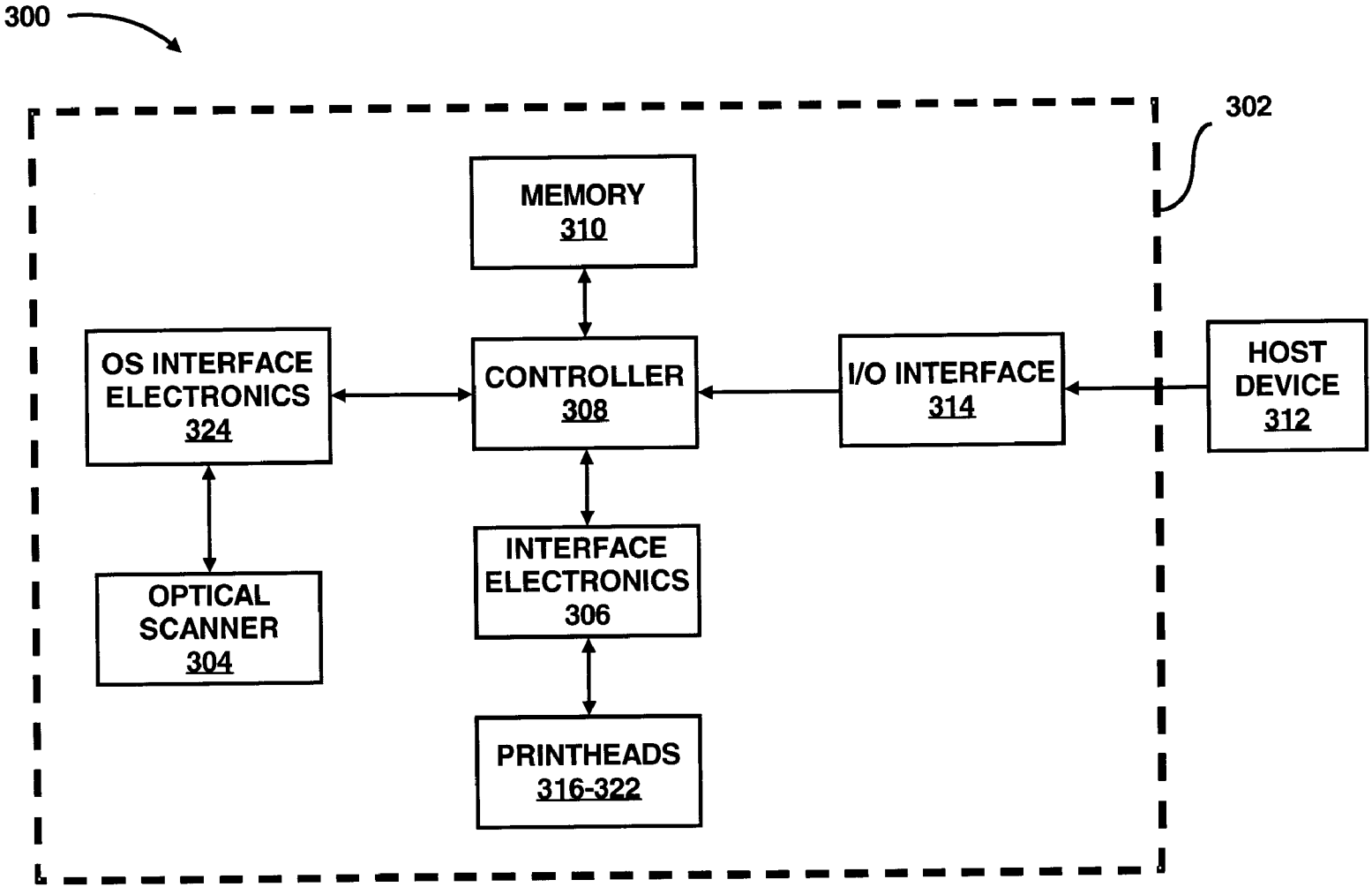
FIG. 3 is an exemplary block diagram of a printing mechanism in accordance with an embodiment of the present invention.

Referring to FIG. 3, there is illustrated an exemplary block diagram 300 of a printer 302 in accordance with an embodiment of the present invention. As will become better understood from a reading of present disclosure, the following description of the block diagram 300 illustrates one manner in which a printer 302 having an optical scanner 304 may be operated in accordance with an embodiment of the present invention. In this respect, it is to be understood that the following description of FIG. 3 is but one manner of a variety of different manners in which such a printer 302 may be operated.

The printer 302 is shown as including four printheads 316–322. However, the present invention may operate with any reasonably suitable number of printheads.

The printer 302 may also include interface electronics 306 configured to provide an interface between the controller 308 and the components for moving the carriage 40, e.g., encoder, belt and pulley system (not shown), etc. The interface electronics 306 may include, for example, circuits for moving the carriage, the medium, firing individual nozzles of each printhead, and the like.

The controller 308 may be configured to provide control logic for the printer 302, which provides the functionality for the printer. In this respect, the controller 308 may be implemented by a microprocessor, a micro-controller, an application specific integrated circuit (ASIC), and the like. The controller 308 may be interfaced with a memory 310 configured to provide storage of a computer software that provides the functionality of the printer 302 and may be executed by the controller. The memory 310 may also be configured to provide a temporary storage area for data/file received by the printer 302 from a host device 312, such as a computer, server, workstation, and the like. The memory 310 may be implemented as a combination of volatile and non-volatile memory, such as dynamic random access memory ("RAM"), EEPROM, flash memory, and the like. It is, however, within the purview of the present invention that the memory 310 may be included in the host device 312.

The controller 308 may further be interfaced with an I/O interface 314 configured to provide a communication channel between the host device 312 and the printer 302. The I/O interface 312 may conform to protocols such as RS-232, parallel, small computer system interface, universal serial bus, etc.

Optical scanner interface electronics 324 may interface the optical scanner 304 and the controller 308. The optical scanner interface electronics 324 may operate to convert instruction signals from the controller 308 to the optical scanner 304. In addition, the optical scanner interface electronics 324 may also operate to convert information sensed by the optical scanner 304 into a format capable of being interpreted by the controller 308. The conversions of the instructions and the information may be accomplished by any reasonably suitable manner known to those skilled in the art.

Figure 4:
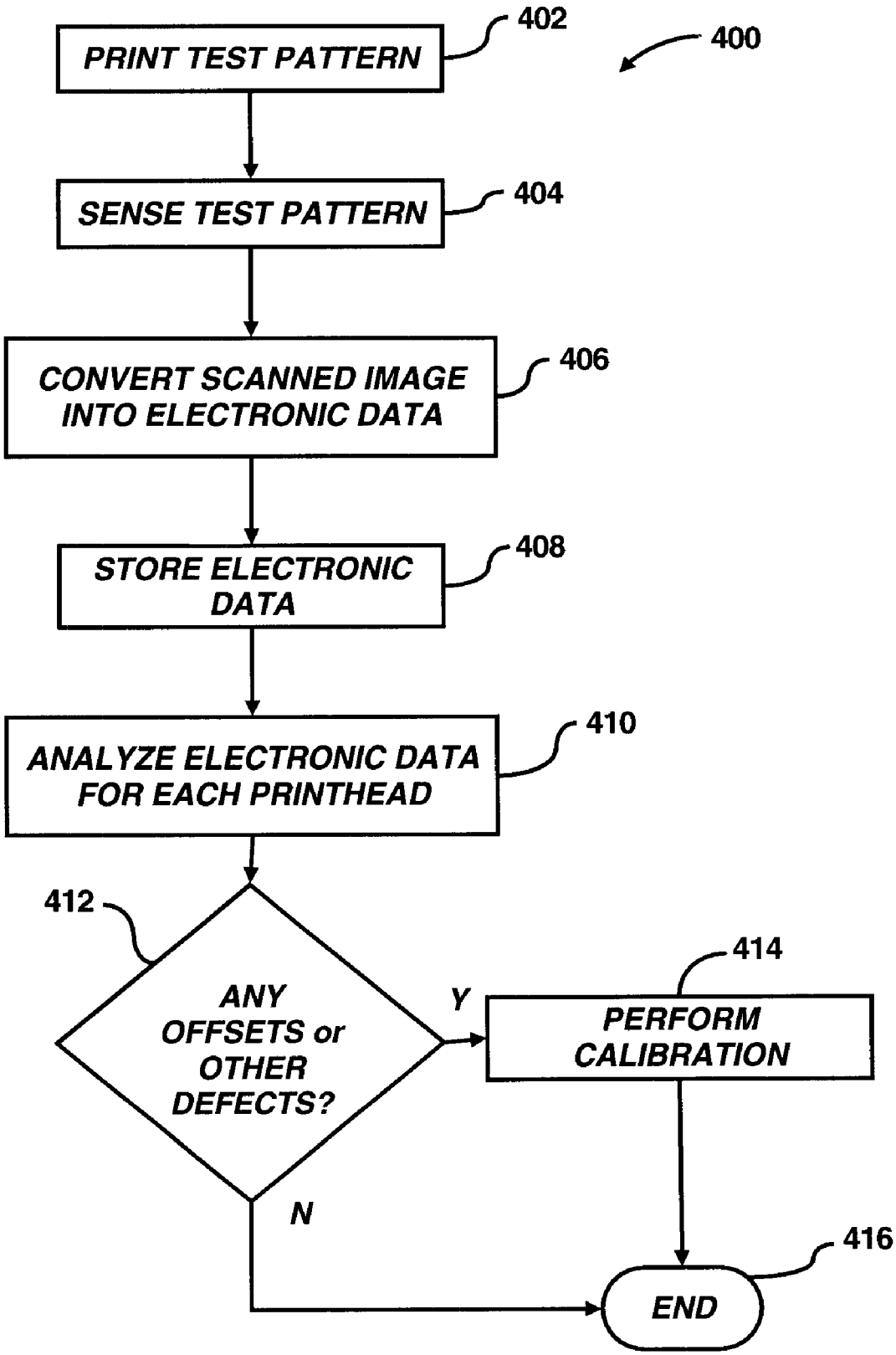
FIG. 4 is an exemplary flow diagram of a manner in which an embodiment of the present invention may be practiced.

Referring to FIG. 4, there is illustrated an exemplary flow diagram 400 of a simplified manner in which the principles of the present invention may be practiced. It is to be understood that the steps illustrated in the flow diagram 400 may be contained as a utility, program, subprogram, in any desired computer accessible medium. In addition, the flow diagram 400 may be embodied by a computer program, which can exist in a variety of forms both active and inactive. For example, they can exist as software program(s) comprised of program instructions in source code, object code, executable code or other formats. Any of the above can be embodied on a computer readable medium, which include storage devices and signals, in compressed or uncompressed form.

Exemplary computer readable storage devices include conventional computer system RAM (random access memory), ROM (read only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. Although particular reference is made in the following description of FIG. 4 to the controller 308 as performing certain printer functions, it is to be understood that those functions may be performed by any electronic device capable of executing the above-described functions.

As illustrated in FIG. 4, according to a preferred embodiment of the present invention, a test pattern is printed onto a recording medium at step 402. As an example, the printing of the test pattern may be initiated by the controller 308 in response to one or more of the pens 316–322 being replaced, at a user's request or due to a scheduled action. According to another embodiment of the present invention, a plurality of test patterns, e.g., 92–96, may be applied on the recording medium. The test patterns may be applied by the printheads at various speeds, e.g., corresponding to various printmodes of the printing mechanism. In this respect, any offsets and/or deviations (e.g., deviations in ink drop volume, ink drop placement errors, etc.) in the printheads may be detected with greater accuracy.

The test pattern(s) is sensed by operation of the optical scanner 304 at step 404. The scanned image of the test pattern is converted into electronic data, for example by the optical scanner interface electronics 324 at step 406. At step 408, the electronic data may be stored, for example in memory 310 for future reference by the controller 308. The controller 308 may also analyze the electronic data obtained for each of the printheads to determine any offsets or other printing defects, e.g., nozzle-outs, clogs, etc., in a manner generally known to those skilled in the art, at step 410. When a plurality of test patterns are analyzed, the determination of the existence of any offsets or other printing defects (e.g., deviations from nominal ink drop volumes, drop placement errors, etc.) may be made with greater accuracy by comparing the speeds of the printheads during the printing of the test patterns.

At step 412, it may be determined whether any of the printheads has any offsets or contain other printing defects, e.g., deviations in ink drop volume, ink drop placement errors, etc. In response to a determination that any of the printheads are offset or contain other printing defects, a calibration operation may be performed as indicated at step 414. The calibration operation may entail any number of modifications to the timing of ink application by the printheads to ensure that the ink drops are applied substantially at their intended locations. In addition, when a plurality of test patterns are sensed, the calibration operation may also entail the calibration of the printheads for various printmodes, e.g., various printhead scanning speeds. That is, because the printheads may have varying degrees of offsets for various printmodes, the printheads may be more accurately calibrated according to the individual offsets for the various printmodes, thus resulting in a more accurate printing operation Following step 414 and/or step 412, the calibration operations may be concluded as indicated at step 416.

By virtue of the above-described embodiments of the present invention, the calibration of the printheads of a printing mechanism may be performed in a relatively short period of time as compared to known techniques. As an example, current printing mechanisms may possess printheads having a relatively high swath height. For a conventional LED sensor to scan a test pattern having a relatively high height would require the LED sensor to perform multiple passes because of its limited field of view. However, by operation of an embodiment of the present invention, the same test pattern may be scanned in a single pass. Therefore, a substantially greater throughput improvement may be obtained by operation of the present invention.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method of calibrating ink ejection elements of an image forming device, said image forming device comprising a carriage supporting said ink ejection elements and an optical scanner, said method comprising:

printing a plurality of test patterns onto a print medium by scanning ink ejection elements over a print medium at various speeds;

sensing each of said plurality of test patterns with an optical scanner by scanning a substantial width of each of said plurality of test patterns in a single pass of said optical scanner;

determining whether any of said ink ejection elements contains at least one defect based on said sensed test patterns; and calibrating said ink ejection elements determined to contain said at least one defect.

2. The method according to claim 1, wherein said step of determining whether any of said ink ejection elements contains said at least one defect further comprises comparing the sensed test patterns in relation to the speed the ink ejection elements were traveling during the printing of said test patterns.

3. The method according to claim 2, wherein said step of calibrating said ink ejection elements determined to contain at least one defect further comprises calibrating said ink ejection elements for various printmodes.

4. A system for calibrating ink ejection elements in an image forming device, said system comprising:

a controller operable to control said ink ejection elements to fire a set of ink drops onto a print medium in the form of a test pattern;

an optical scanner configured to sense said test pattern, wherein said optical scanner is configured to scan a substantial width of said test pattern in a single pass of said optical scanner;

said controller being configured to determine whether any of said ink ejection elements contains at least one defect by analyzing said test pattern; and said controller being further configured to calibrate ink ejection elements containing at least one defect.

5. The system according to claim 4, wherein said optical scanner is configured to scan the width of said test pattern in a single pass of said optical scanner.

6. The system according to claim 4, further comprising: means for converting said scanned test pattern into electronic data; and means for storing said electronic data prior to determining whether any of said ink ejection elements contains at least one defect.

7. The system according to claim 4, wherein said controller is further operable to control said plurality of nozzles to fire a set of ink drops onto said print medium in the form of a plurality of test patterns by controlling said ink ejection elements to print said plurality of test patterns onto said print medium at various speeds and wherein said optical scanner is further configured to sense each of said plurality of test patterns.

8. The system according to claim 7, wherein said controller is operable to control the optical scanner to scan each of the plurality of test patterns.

9. The system according to claim 8, wherein said controller is operable to determine whether any of said ink ejection elements contains said at least one defect by comparing the sensed test patterns in relation to the speed the ink ejection elements were traveling during the printing of the test patterns.

10. A computer readable storage medium on which is embedded one or more computer programs, said one or more computer programs implementing a method for calibrating ink ejection elements of an image forming device, said one or more computer programs comprising a set of instructions for:

printing a test pattern onto a print medium with said ink ejection elements;

sensing said test pattern with an optical scanner by scanning a substantial width of said test pattern in a single pass of said optical scanner;

determining whether any of said ink ejection elements contains at least one defect; and calibrating said ink ejection elements determined to contain said at least one defect.

11. The computer readable storage medium according to claim 10, said one or more computer programs further comprising a set of instructions for:

scanning the width of said test pattern in a single pass of said optical scanner.

12. The computer readable storage medium according to claim 10, said one or more computer programs further comprising a set of instructions for:

converting said scanned test pattern into electronic data; and storing said electronic data prior to determining whether any of said ink ejection elements contain said at least one defect.

13. The computer readable storage medium according to claim 12, said one or more computer programs further comprising a set of instructions for:

analyzing said electronic data to determine whether any of said ink ejection elements contains at least one defect.

14. The computer readable storage medium according to claim 10, said one or more computer programs further comprising a set of instructions for:

printing a plurality of test patterns by scanning said ink ejection elements over said print medium at various speeds; and sensing each of said plurality of test patterns.

15. The computer readable storage medium according to claim 14, said one or more computer programs further comprising a set of instructions for:

comparing the sensed test patterns in relation to the speed the ink ejection elements were traveling during the printing of said test patterns; and calibrating said ink ejection elements for various print-modes.

* * * * *